US005573553A

United States Patent [19]

McBride et al.

[11] Patent Number: 5,573,553

[45] Date of Patent: Nov. 12, 1996

[54] METHOD FOR IMPROVING THE BLEACH RESISTANCE OF DYED TEXTILE FIBER AND PRODUCT MADE THEREBY

[75] Inventors: Daniel T. McBride, Chesnee, S.C.; Terry M. Fannon, LaGrange, Ga.

[73] Assignee: Milliken Research Corporation, Spartanburg, S.C.

[21] Appl. No.: 520,037

[22] Filed: Aug. 28, 1995

Related U.S. Application Data

[63] Continuation of Ser. No. 21,912, Feb. 24, 1993, abandoned, which is a continuation-in-part of Ser. No. 873,463, Apr. 24, 1992, abandoned.

[51] Int. Cl.[6] ..... D06M 13/332; D06M 15/00

[52] U.S. Cl. ..... 8/115.56; 8/115.58; 8/115.66; 8/115.7; 8/194; 8/196; 428/395; 428/394; 428/392; 428/365; 427/384; 427/372.2; 427/394

[58] Field of Search ..... 8/194, 195, 196, 8/115.65, 127.6, 116.1, 115.56, 120, 115.58, 115.59, 115.61, 115.66, 115.7; 427/393.4, 384, 372.2, 394; 428/395, 394, 392, 365

[56] References Cited

U.S. PATENT DOCUMENTS

| | | | |
|---|---|---|---|
| 2,373,191 | 4/1945 | Landolt | 8/18 |
| 2,493,765 | 1/1950 | Le Compte | 8/127.6 |
| 2,714,097 | 7/1955 | Watson et al. . | |
| 2,890,097 | 6/1959 | Coe | 8/194 |
| 3,078,138 | 2/1963 | Miller et al. | 8/127.6 |
| 3,390,949 | 7/1968 | Dunkel et al. | 8/127.6 |
| 3,484,272 | 12/1969 | Zahn et al. | 428/395 |
| 3,537,808 | 11/1970 | Gardon | 8/194 |
| 3,719,547 | 3/1973 | Martin et al. | 161/67 |
| 3,844,713 | 10/1974 | Saunders et al. | 8/165 |
| 3,892,525 | 7/1975 | Lofquist | 8/165 |
| 3,917,449 | 11/1975 | Wells et al. | 8/165 |
| 4,105,404 | 8/1978 | Lofquist et al. | 8/165 |
| 4,475,918 | 12/1984 | Kissling et al. | 8/495 |
| 4,588,413 | 5/1986 | Keil et al. | 8/543 |
| 4,931,065 | 6/1990 | Baumgarte et al. | 8/188 |
| 4,937,123 | 6/1990 | Chang et al. | 428/96 |
| 5,001,004 | 3/1991 | Fitzgerald et al. | 428/263 |
| 5,032,136 | 7/1991 | Fitzgerald et al. | 8/115.6 |
| 5,082,697 | 1/1992 | Patton et al. | 427/340 |

FOREIGN PATENT DOCUMENTS

| | | |
|---|---|---|
| 744525 | 7/1970 | Belgium . |
| 0431423 | 11/1990 | European Pat. Off. . |
| 865151 | 4/1940 | France . |
| 1-132691 | 6/1986 | Japan . |
| 1259082 | 1/1972 | United Kingdom . |

OTHER PUBLICATIONS

Derwent Publications Ltd., AN 89–200826 & JP–A–61 132 691, 20–Jun.–1986 (Abstract Only).

Derwent Publications Ltd., AN–89–361950 & JP–A–1 272 887, Oct. 1989, (Abstract Only).

Kirk–Othmer Encyclopedia of Chemical Technology, Third Edition, vol. 18, pp. 350–351 (month unknown). 1982.

*Primary Examiner*—Prince Willis, Jr.
*Assistant Examiner*—Alan D. Diamond
*Attorney, Agent, or Firm*—Terry T. Moyer; Timothy J. Monahan

[57] ABSTRACT

A process for protecting a dyed textile fiber from decolorization caused by exposure to bleach, and improving colorfastness is provided by applying an aqueous solution of non-volatile, polymeric salt forming monomers, such as hexamethylenediamine and adipic acid, to the textile fiber followed by drying the fiber to polymerize the monomers and form a non-volatile, polymeric salt film thereon. The process is especially suitable for treating dyed polyamide fiber used in floor covering products.

20 Claims, No Drawings

METHOD FOR IMPROVING THE BLEACH RESISTANCE OF DYED TEXTILE FIBER AND PRODUCT MADE THEREBY

RELATED APPLICATIONS

This application is a continuation of Ser. No. 08/021,912, filed on Feb. 24 1993, now abandoned, which is a continuation-in-part of Ser. No. 07/873,463, filed Apr. 24, 1992, now abandoned.

BACKGROUND OF THE INVENTION

This invention relates to formation of a non-volatile polymeric salt film derived from polyamines and polycarboxylic acids on a dyed textile fiber to prevent color loss, especially by chemical attack from solutions of chlorine bleach, and to improve colorfastness.

Polymeric coatings have been applied to textile fibers to solve a wide range of problems. It is well known that melamine-formaldehyde, urea-formaldehyde, thiourea-formaldehyde and phenyl-formaldehyde resins may be applied to cellulosic fibers to impart anti-creasing properties, prevent shrinking and for fixation of dyestuffs. Additionally, these resins have been found to protect dyed cellulose textiles from color loss when they are exposed to chlorine solutions. In Landolt, U.S. Pat. No. 2,373,191, a process is disclosed for combining a dyed fiber, such as cotton, which has been treated with one of the aforementioned resins and cured, with a fiber, such as wool, which is to be treated in a chlorine solution to prevent shrinkage. Subsequent application of a chlorine solution to the fiber mixture should not discolor the dyed cotton fiber. Recently, formaldehyde has been targeted as a hazardous chemical in the work place and its use has become severely restricted. Other drawbacks of the urea-formaldehyde type resins include yellowing and stiffness imparted to the treated fiber.

A number of known processes are directed to providing permanent press or anti-shrink properties to wool and blends of wool fibers with some type of polymeric film. For example, Intermacom A.G.'s British Patent 1,259,082 discloses in situ formation of a polyamide film on a textile fiber. In situ film formation may be achieved by interfacial polymerization using a diamine and diacid chloride or diacid ester. Alternatively, a polyamide emulsion or solution may be applied to a textile fiber and cured, such as in Coe, U.S. Pat. No. 2,890,097. These processes have limited applications to the treatment of carpet, since they tend to impart a harsh hand to the finished product and have not been demonstrated to impart bleach resistance to dyed textile fibers.

Textile floor coverings, particularly polyamide pile carpet, have been the focus of a variety of protective treatments. Sulfonated phenol-formaldehyde condensation products, styrene-maleic anhydride copolymer and polymers and copolymers of methacrylic acid have been applied to polyamide fibers to prevent staining, and represent the "stain blocker" technology. Ozone protection has been sought by coating polyamide fibers with one or more of N,N'-disubstituted thioureas, polythioureas, tertiary amines formed by the reaction of epoxides and amines and organic phosphites. Also, a combination of film-forming polyvinyl chloride and water insoluble organic phosphate ester has been applied to polyamide fiber to provide flame retardancy.

Despite the availability of the aforementioned treatments, serious shortcomings remain in protecting floor covering from discoloration by bleach. This problem is especially prevalent at health care installations where bleach solutions are routinely used to disinfect furniture, equipment, fixtures, and the interior of the building. Even a spill of a dilute bleach solution, as low as 0.05 wt. % solution of sodium hypochlorite, can ruin a section of carpet.

One approach to eliminating the risk of discoloration caused by bleach has been to provide solution dyed fibers. Thus, the dye is incorporated into the polymer melt prior to spinning. The colorant is evenly distributed throughout the cross-section of the fiber. If the fiber is later exposed to bleach, only the dye at the surface will be affected and the overall color of the fiber will not be significantly diminished.

Nevertheless, solution dyed fibers have several drawbacks, not the least of which is that they are more expensive to produce. Further, solution dyed fibers introduce additional complications to the manufacturing process. Large inventories of each color of fiber must be maintained rather than a single inventory of undyed fibers, which can later be dyed to the desired color. If patterning is desired, one must either tuft the carpet with two or more different colored yarns or print the pattern over the base color. The first alternative is very expensive. Overprinted patterns, which are only applied to the surface of the fiber, are typically used, but the patterns are subject to bleach attack.

In addition to the problems encountered from bleach attack, many dyed textile fibers, especially those incorporated into floor coverings, are susceptible to wet crocking. The problem is frequently encountered during shampooing, where the combination of mechanical agitation and detergents particularly is severe.

SUMMARY OF THE INVENTION

Therefore, one of the objects of this invention is to provide an economical dyed textile fiber which is resistant to discoloration by chlorine bleach.

Another object of this invention is to provide a treatment to impart bleach resistance which can be applied after the fiber is dyed or to textiles having a pattern printed thereon.

Yet another object of this invention is to provide a treatment for imparting bleach resistance which does not contain formaldehyde, discolor or adversely impact on the hand of the textile fiber.

A further object of this invention is to provide a treatment which will improve the colorfastness of dyed textile fiber, especially with regard to wet crocking and shampooing.

Accordingly, a method for treating a dyed textile fiber is provided having the steps of applying solutions of non-volatile, polymeric salt forming, poly-functional monomers to the dyed textile fiber, drying the textile fiber at a temperature sufficient to polymerize the monomers and below a softening temperature of the textile fiber, to form a water insoluble, non-volatile polymeric salt film on the textile fiber. A textile product made according to the above method is also included within the scope of the invention.

The invention features application of the treatment solution by conventional techniques, such as padding, baths or spraying. The solution may be aqueous, thereby avoiding the emission of organic solvents. The treatment solution may be applied to carpet which has already been installed and the non-volatile polymeric salt allowed to equilibrate at ambient temperature.

DESCRIPTION OF THE PREFERRED EMBODIMENT OF THE INVENTION

Without limiting the scope of the invention, the preferred features and embodiment of the invention is hereinafter set forth. The object of the invention is to provide dyed textile fiber with protection from chemical attack by chlorine bleach, which is known to discolor the dye, and improved colorfastness. The most common route of exposure to damage occurs when cleaning solutions or disinfectants containing sodium hypochlorite are spilled on carpet. Nylon or polyamide fiber is used predominantly as the face material for floor covering and is the focus of the present invention.

Of course, an important criteria in evaluating the treatment is the degree to which the textile fiber is protected from discoloration when exposed to a chlorine bleach solution. For disinfecting purposes, the Center for Disease Control recommends a 0.05% solution of sodium hypochlorite for non-porous surfaces, such as counter tops, and a 0.5% solution for porous surfaces, such as grout. Sodium hypochlorite is referred to generally herein as chlorine bleach or bleach. Spills of bleach solution may remain unattended on the carpet for hours or even days, which adds to the strain placed on any protective treatment.

Additionally, the protective treatment should be durable, be able to withstand foot traffic and multiple washings, and improve colorfastness. With regard to cleaning the carpet with "wet" techniques, such as hot water extraction, it is important that the treatment be water insoluble. The protective treatment should have a minimum impact on the physical characteristics of the textile fiber. Therefore, the treatment should not impart a harsh hand to the fiber, cause matting or yellowing.

Heightened environmental awareness has limited the acceptable monomers, polymers and solvents which may be used in a protective treatment. For example, resins containing formaldehyde and organic solvents, especially those containing aromatics, are undesirable. Even treatments employing less toxic organic solvents can substantially increase manufacturing costs when emission controls are required.

The bleach resistance treatment is applicable to both natural and synthetic textile fibers. Thus, by way of example, fibers made from the following materials may be effectively treated according to the methods disclosed herein: polyamides, polyesters, polyolefins, acrylics, and cellulosic fibers such as cotton and rayon. The treatment method is especially useful on polyamide fibers, particularly Nylon 6 and Nylon 6,6. The term "fiber" is used in a broad sense and is intended to include both staple fibers and filaments. It is not material to the practice of the invention whether the fibers are treated prior to or after being formed into a textile product as long as the fiber has first been dyed. Accordingly, the fiber may be treated in the form of a staple fiber, filament, yarn, woven, knitted, or nonwoven fabric, or adhered to a substrate as by tufting or adhesion. From a manufacturing point of view, since most fibers are dyed after being formed into a textile product, the bleach resistance treatment will usually be applied to a fabric or floor covering product.

The present treatment method has applications when any dye which is susceptible to discoloration by chlorine bleach, is used to color textile fibers. The dye may be fixed to the surface of the textile fiber by, for example, chemical reaction, ionic association or with a binder. Representative examples of types of dyes which may be protected by the instant treatment include acid dyes, basic dyes, cationic dyes, direct dyes, dispersed dyes, fiber-reactive dyes, metalized dyes, pre-metalized dyes, and vat dyes. Classes of dyes within each of these categories which are particularly susceptible to attack by hypochlorite ions are acid dyes and fiber reactive dyes. Selection of an appropriate dye for a particular type of fiber is well within the knowledge of those with skill in the art. Likewise, application of the dye to a particular textile product such as by yarn dyeing, range dyeing, jet dyeing, solution dyeing or other conventional techniques, is a routine matter. Textile products containing a base color, including those made of solution dyed synthetic fibers, which have been overprinted with a pattern, such as by ink jet printing, screen printing, or gravure printing, may be treated to provide bleach resistance. Since the method of imparting bleach resistance to the textile fiber comprises forming a non-volatile, polymeric salt film on the fiber surface, the particular dye or dyeing technique is not considered critical.

Generally, bleach resistance is imparted to a textile fiber by applying solutions of monomers and allowing the monomers to react to form a protective film on the fiber. The monomers may include oligomers or relatively low molecular weight "polymers" containing functional end groups, which may be reacted to form a non-volatile salt film. The monomers are characterized by compounds which form polymeric, non-volatile salt films, requiring that they are at least bifunctional. Higher functionality monomers, such as a combination of butane tetracarboxylic acid and a diamine may be used effectively.

In a preferred embodiment the diamine used in the reaction to form a polymeric salt is a low molecular weight "polymeric" diamine made by reacting one mole of an ester of a diacid or diacid chloride with two moles of a diamine. For example, one mole of a methyl ester of adipic acid, glutaric acid or succinic acid, may be reacted with 2 moles of hexamethylene diamine to form a low molecular weight polyamide, diamine. The "polymeric" diamine is substantially less volatile than hexamethylene diamine, and thus, does not pose a health risk. The "polymeric" diamine contains a diamine covalently bonded to the diacid ester to form an amide linkage and is distinguished from the polymeric salt film formed on the fiber by the reaction of a diamine and diacid under conditions which do not form a polyamide.

The monomers used to form the polymeric salt are preferably water soluble or easily emulsified or dispersed in an aqueous solution. Monomers having molecular weights less than 1,000 are preferred, those with molecular weights less than 750 are most preferred.

Thus, one important group of monomers useful herein are combinations of $C_{2-20}$ polyamines and polycarboxylic acids. By way of example, suitable polyamines include: ethylenediamine, hexamethylenediamine, 1,8-octanediamine and piperazine. And, examples of suitable polycarboxylic acids include: carbonic acid, oxalic acid, glutaric acid, adipic acid, pimelic acid, suberic acid, azelaic acid, sebacic acid, dodecanedioic acid, isophthalic acid, butane tetracarboxylic acid and terephthalic acid. Especially useful are combinations of diamines and diacids, most preferable are hexamethylene diamine and adipic acid. Polymers formed from the reaction of diamines and dibasic acid will be referred to as AABB type polymeric salts.

Another class of monomers are $C_{2-20}$ amino acids which form AB type polymeric salts. Examples of these type monomers include 6-aminohexanoic acid, aminoundeconoic acid, 2-pyrrolidinecarboxylic acid, glycine, cystine, asparagine, glutamine, lysine, arginine, tyrosine, and aminododeconoic acid. Also included within the scope of useful monomers are lactams formed from the aforementioned amino acids, where possible, especially $\epsilon$-caprolactam, provided the lactam is heated in the presence of water to form an amino acid salt.

The treatment solution has a total monomer concentration of from 2 to 30 wt. %, preferably from 5 to 20 wt. %. The solvent itself is selected on the basis of its ability to form a solution with the monomers, preferably at ambient temperatures. However, it is important that the textile fiber itself is not soluble in or plasticized by the solvent. The solvent is preferably aqueous or a $C_1$–$C_8$ alcohol. Other polar solvents and organic solvents may be employed, however, due to problems with toxicity or other limitations on emissions, their use is less desirable.

The treatment solution is applied to a dyed textile fiber, which may be in the form of a staple fiber, filament, yarn, fabric, or adhered to a substrate. Any of a number of conventional techniques for wetting a textile fiber with a liquid solution may be used. For example, the treatment solution may be applied to pile carpet by padding, spraying, or immersion in a bath. The treatment solution can be applied to carpet which has already been installed, and may even be accompanied by mechanical agitation to ensure thorough wetting. The wet pick up is typically from 5 to about 50 wt. % treatment solution based on the dry weight of the textile fiber, not including a substrate. A wet pick up of approximately 25% of the weight of the textile fiber is typical.

The amount of treatment solution applied to the textile fiber may conveniently be gauged in terms of the weight percent of monomer solids per weight of fiber, which when reacted, will represent the weight percent of polymeric salt film on the fiber. The lower limit of application believed to provide at least a modicum of protection is about one weight percent solids per weight of fiber. The amount of monomer applied may be increased up until the point that an adverse effect on the hand and matting of the textile fibers is observed. As a practical matter, diminishing returns of increased protection versus cost will be seen after approximately 10 wt. % monomer solids per weight of fiber is reached. Preferably, from 2 to 7 wt. % monomer solids per textile fiber is achieved by application of the treatment solution.

The next step of the process is to allow the monomers to react to form a protective, non-volatile, polymeric salt film on the textile fibers. The treatment solution will react at ambient conditions, at least 20° C. However, in the case of application of the treatment solution to installed carpet, that is a viable method of achieving protection. Additionally, when treating installed carpet, it is important to consider the solvent selected for the treatment solution. Aqueous solutions are preferred for health, safety, and environmental concerns, since the solvent evaporates after application as the monomers begin to react.

Those with skill in the art will recognize that the pH of the treatment solution may need to be adjusted to dissolve, emulsify or disperse the monomers. For example, amino acids such as cystine, arginine and asparagine are more readily dispersed at a pH of 11–12 in an aqueous solvent. After application of the treatment solution to the textile fiber, an acid, such as citric acid, may be applied to lower the pH and precipitate the monomers. Preferably, the pH of the treatment solution is returned to neutral, since the treatment is found to be most effective in protecting against bleach attack at a pH of 6–8, preferably 7. In that regard, a buffer, such as sodium citrate, may be useful in maintaining a neutral pH and may be added with the citric acid.

In a preferred embodiment, salicylic acid is added to the treatment solution and has been found to enhance the bleach resistance of the treated textile. Without being bound to a particular theory, it is believed that the -OH group of the acid participates in the reaction with the hypochlorite ion. Unlike other phenolic compounds, the salicylic acid does not appear to cause yellowing of the textile fiber. The pH of the treatment solution may be adjusted to 11–12 to dissolve the salicylic acid prior to application. From 0.1 to 7 wt. % of salicylic acid per weight of textile fiber may be applied, preferably from 0.5 to 5.0 wt. % of salicylic acid.

It has been found that some monomers, such as the "polymeric" diamine containing two moles of hexamethylene diamine and one mole of a dibasic ester described above may act as an emulsifier to disperse salicylic acid at neutral pH. Consequently, a treatment solution containing a "polymeric" diamine, or other emulsifier, and salicylic acid could be neutralized prior to application of the solution to a textile fiber.

While it is preferable to apply all of the monomers to the textile fiber in a single treatment solution, the invention is not so limited. For example, a solution of the diamine could be applied first to the textile fiber followed by application of a second solution containing the diacid, or vice versa. As discussed above, the pH of the treatment solution containing one or more monomers may be adjusted after the treatment solution is applied to a textile fiber.

The durability of the protective non-volatile polymeric salt film may be enhanced by reacting the treatment solution at higher temperatures. For example, polyamide fiber in the form of a tufted pile carpet, may be heated in an oven to temperatures up to the softening point of the fiber. Thus, reaction temperatures of from 100° C. to the softening temperature of the fiber may be used. Typically, the textile fiber is exposed to temperatures of from 100° to 200° C., preferably 120° to 160° C. The length of exposure will be determined by the time required to evaporate the solvent and to drive the reaction to completion.

Catalysts may be employed in the treatment solution to improve the configuration of the non-volatile, polymeric salt on the surface of the fiber when the treatment is performed at lower temperatures, especially when reaction occurs at ambient conditions. Since bleach resistance may be lost if the protective film is washed off during normal carpet cleaning, it is preferable that the reaction proceed to the extent that a water-insoluble film is formed on the textile fiber.

Without being bound to a particular theory, it is hypothesized that the non-volatile, polymeric salt film formed on the textile fiber provides a primary amine functionality which is sacrificed to the bleach solution. In particular, the amino nitrogen of the non-volatile polymeric salt film reacts with the hypochlorite ion of the bleach solution.

Additional compounds used to improve the characteristics of textile fibers may be incorporated into the treatment solution so long as they do not interfere with the non-volatile polymeric salt formation. For example, fluorocarbon polymers which provide anti-soiling and water repellency, and stain blockers such as condensation products containing sulfonated phenols may be employed.

The invention may be further understood by references to the following examples, but the invention is not to be construed to be unduly limited thereby. Unless otherwise indicated, all parts and percentages are by weight.

EXAMPLE 1

A 26 oz/yd$^2$, stock dyed with premetalized and standard acid dyes, loop pile, nylon 6,6 carpet is pretreated by spraying onto the pile a homogeneous aqueous solution containing 8 percent by weight of hexamethylenediamine and 8 percent by weight of adipic acid. The wet pickup is about 25 percent based on the dry weight of the nylon face fiber. The carpet is then submitted to a drying temperature of 275° F. for a period of 7 minutes. The treated carpet shows no appreciable change in appearance. The treated carpet and an untreated control are then subjected to a 0.5 percent solution of sodium hypochlorite (the recommended Center for Disease Control concentration for disinfecting purposes for porous surfaces) for a period of 24 hours, after which the carpet is washed with water and dried. Visual comparison of the treated carpet to an untreated control sample clearly reveals that the treated carpet has superior resistance to color loss.

EXAMPLE 2

The procedure of Example 1 is repeated in all respects except the carpet is 28 oz/yd$^2$ stock dyed nylon 6,6 cut pile. Identical results as those of Example 1 are obtained.

EXAMPLE 3

The procedure of Example 1 is repeated in all respects except the 26 oz/yd$^2$ stock dyed nylon 6,6 carpet is also overprinted with a pattern using similar acid dyes as in Example 1, prior to application of the treatment solution. Identical results as those of Example 1 are obtained.

EXAMPLE 4

The procedure of Example 1 is repeated in all respects except the carpet is made from a solution dyed nylon 6,6 fiber and is overprinted with a pattern prior to application of the treatment solution. Identical results as those of Example 1 are obtained on the overprinted pattern, the solution dyed color being unaffected on both the treated and control carpet.

EXAMPLE 5

The procedure of Example 1 is repeated in all respects except the carpet is treated with a homogeneous solution of 10 percent by weight of caprolactam and 10 percent by weight of urea. Identical results as those of Example 1 are obtained.

EXAMPLE 6

The procedure of Example 1 is repeated in all respects except butanetetracarboxylic acid is substituted for the adipic acid. Similar results as those of Example 1 are obtained.

EXAMPLE 7

The procedure of Example 2 is repeated in all respects except the treated carpet is subjected to simulated wear and cleaning of 5 years before exposure to the hypochlorite solution. Similar results as those of Example 1 are obtained.

EXAMPLE 8

Example 2 was repeated in all respects except the treated sample was air dried. A visual comparison of the treated sample to the untreated control reveals a decrease in color loss in the treated sample but not as significant as in the untreated control.

The following examples demonstrate the improved colorfastness of dyed textile fibers which have been treated according to the present invention and subjected to commercial cleaning solutions or water.

EXAMPLE 9

Example 3 was repeated in all respects except that both the treated and untreated control samples ere scrubbed with a 5% solution of Fiber Fresh from Service Master Company. The samples were then covered by a multifiber test strip available from Test Fabrics, Inc. The test strip was in turn covered by a ¼" plexiglass and placed in an over at 100° F. A 5 weight was placed on the plexiglass. The samples remained in the over for 18 hours, after which the dye bleeding into the multifiber test strip was graded on a 5 point AATCC grey scale. The treated sample showed a passing rating of 4.0, whereas the untreated control had a failing rating of 3.0.

EXAMPLE 10

Example 9 was repeated in all respects except that the carpet of Example 4 was used. Identical results were obtained on the overprinted pattern.

EXAMPLE 11

Example 3 was repeated in all respects except that both the untreated control and the treated samples were subjected to deionized water in a beaker for 15 minutes. Next, the samples were removed from the water and shaken until the amount of water remaining was 2.5 to 3 times the original dry weight of the carpet. The samples were covered with a multifiber test strip, covered with ¼" plexiglass and placed in a 100° F. oven. A 5 pound cylindrical weight was placed on the plexiglass. The samples remained in the over for 18 hours after which the dye bleeding into the multifiber test strip was graded on a 5 point AATCC grey scale. The treated sample showed a passing 4.5 rating, whereas the untreated control had a failing 3.5 rating.

EXAMPLE 12

Example 11 was repeated except that the carpet of Example 4 was used. Similar results were obtained on the overprinted pattern.

There are, of course, many alternate embodiments and modifications which are intended to be included within the scope of the following claims.

What we claim is:

1. A method for treating a dyed synthetic textile fiber to improve its bleach resistance, comprising the steps of applying a solution of monomers to said dyed textile fiber, wherein said monomers are a primary amine and a carboxylic acid, and the molecular weight of each of said monomers is less than 1,000, and drying said textile fiber at a temperature of from 20° C. to 200° C. to form a non-volatile, polymeric salt film on said textile fiber, without forming a polyamide from said monomers.

2. The method of claim 1 wherein said solution contains a solvent selected from the group consisting of water and $C_1$–$C_8$ alcohols.

3. The method of claim 2 wherein said solution is applied to said textile fiber to achieve 1 to 10 wt. % monomer solids based upon the weight of said textile fiber.

4. The method of claim 3 wherein said textile fiber is dyed with an acid dye or disperse dye.

5. The method of claim 4 wherein said solution is aqueous.

6. The method of claim 5 wherein said textile fiber is selected from the group consisting of nylon 6,6 and nylon 6 fiber and said fiber is in the form of carpet.

7. The method of claim 5 wherein said drying is at a temperature of from 100° to 200° C.

8. A method for treating a dyed textile fiber selected from the group consisting of polyamide and polyester fiber, to improve its bleach resistance, comprising the steps of applying an aqueous solution of monomers to said dyed textile fiber to achieve 1 to 10 wt. % monomer solids based on the weight of said textile fiber, wherein said monomers are selected from the group consisting of:

(a) a mixture of polyamines and polycarboxylic acids;

(b) amino acids; and (c) lactams; provided each of said monomers has a molecular weight of less than 750; and drying said textile fiber at a temperature of from 20° C. to 200° C. to form a non-volatile, polymeric salt film on said textile fiber, without forming a polyamide from said monomers.

9. The method of claim 8 wherein said monomers do not contain amide linkages.

10. The method of claim 9 wherein said textile fiber is selected from the group consisting of nylon 6,6 and nylon 6 fiber and said fiber is in the form of a carpet.

11. The method of claim 8 wherein said monomers are selected from the group consisting of:

(a) mixtures of dicarboxylic acids selected from the group consisting of carbonic acid, oxalic acid, glutaric acid, adipic acid, pimelic acid, suberic acid, azelaic acid, sebacic acid, dodecanedioic acid, isophthalic acid and terephthalic acid; and diamines selected from the group consisting of ethylenediamine, hexamethylenediamine, 1,8-octanediamine decamethylene diamine, piperazine and diamine oligomers which are the condensation product of two moles of a diamine and one mole of a diacid ester or diacid chloride formed from said dicarboxylic acids;

(b) amino acids selected from the group consisting of 6-aminohexanoic acid, aminoundecanoic acid, aminododecanoic acid, glycine, cystine, asparagine, glutamine, lysine, arginine, tyrosine, and 2-pyrrolidinecarboxylic acid; and (c) lactams of 6-aminohexanoic acid, aminoundecanoic acid, aminododecanoic acid or lysine.

12. The method of claim 8 wherein said monomers are (a) a mixture of diamine oligomers and dicarboxylic acids, wherein said diamine oligomers are the condensation products of two moles of a diamine and one mole of a diacid ester or diacid chloride and have two amide linkages.

13. The method of claim 12 wherein said textile fiber is selected from the group consisting of nylon 6,6 and nylon 6 fiber, said fiber having been dyed with an acid dye and said fiber is in the form of carpet.

14. The method of claim 13 wherein said diamine oligomers are the condensation of products of two moles of hexamethylene diamine with one mole of a methyl ester of a diacid selected from the group consisting of adipic acid, glutaric acid and succinic acid.

15. The method of claim 12 wherein said drying is at a temperature of from 120° to 160° C.

16. The method of claim 8 wherein said monomers are selected from the group consisting of (a) a mixture of hexamethylenediamine and adipic acid, (b)aminohexanoic acid, and (c) ε-caprolactam.

17. The method of claim 8 wherein said solution further comprises salicyclic acid, and said solution is applied to said textile fiber to achieve from 0.1 to 7 wt. % of salicyclic acid based on the weight of said textile fiber.

18. A bleach resistant carpet produced by the process steps of applying an aqueous solution of monomers to a dyed, polyamide textile fiber to achieve 1 to 10 wt. % monomer solids based upon the weight of said textile fiber, wherein said monomers are selected from the group consisting of:

(a) a mixture of diamines and diacids;

(b) amino acids; and (c) lactams, and the molecular weight of each of said monomers is less than 1,000, and drying said textile fiber at a temperature of 20° C. to 200° C. to form a non-volatile, polymeric salt film on said textile fiber without forming a polyamide from said monomers.

19. The carpet of claim 18 wherein each of said monomers has a molecular weight of less than 750, said drying is at a temperature of from 120° to 160° C., and said solution is applied to said textile fiber to achieve 2 to 7 wt. % monomer solids based on the weight of said textile fiber.

20. The carpet of claim 19 wherein said monomers do not contain amide linkages.

* * * * *